United States Patent [19]

D'Alessio et al.

[11] 3,936,064

[45] Feb. 3, 1976

[54] SAFETY SKI BINDING

[75] Inventors: Frank P. D'Alessio, Franklin Lakes, N.J.; Erl A. Koenig, Troy, N.Y.

[73] Assignee: GPI, Franklin Lakes, N.J.

[22] Filed: Nov. 13, 1973

[21] Appl. No.: 415,466

Related U.S. Application Data

[63] Continuation-in-part of Ser. No. 121,422, March 5, 1971, Pat. No. 3,838,866.

[52] U.S. Cl. ..... 280/11.35 K; 280/11.35 T

[51] Int. Cl.[2] ..... A63C 9/08

[58] Field of Search ... 280/11.35 K, 11.35 C, 11.35 D, 280/11.35 E, 11.35 Y, 11.35 A, 11.35 P, 11.35 F, 11.35 R

[56] References Cited

UNITED STATES PATENTS

| | | | |
|---|---|---|---|
| 2,614,858 | 10/1952 | Pierce, Jr. | 280/11.35 C |
| 2,793,869 | 5/1957 | Braun | 280/11.35 R |
| 3,061,325 | 10/1962 | Glass | 280/11.35 K |
| 3,241,849 | 3/1966 | Bodycomb | 280/11.35 T |
| 3,353,835 | 11/1967 | Sommer | 280/11.35 M |
| 3,410,568 | 11/1968 | Wiley | 280/11.35 K |
| 3,476,400 | 11/1969 | Unger | 280/11.35 C |
| 3,489,424 | 1/1970 | Gertsch et al. | 280/11.35 K |
| 3,492,014 | 1/1970 | Von Besser | 280/11.35 K |
| 3,649,039 | 3/1972 | Gertsch et al. | 280/11.35 P |
| 3,838,866 | 10/1974 | D'Alessio et al. | 280/11.35 K |

FOREIGN PATENTS OR APPLICATIONS

| | | | |
|---|---|---|---|
| 388,834 | 6/1965 | Switzerland | 280/11.35 Y |
| 1,110,856 | 10/1955 | France | 280/11.35 N |
| 1,964,106 | 11/1970 | Germany | 280/11.35 C |
| 1,276,262 | 10/1961 | France | 280/11.37 T |
| 1,282,053 | 12/1961 | France | 280/11.13 L |
| 76,161 | 8/1961 | France | 280/11.35 K |

*Primary Examiner*—Robert R. Song
*Assistant Examiner*—Milton L. Smith
*Attorney, Agent, or Firm*—Blum, Moscovitz, Friedman & Kaplan

[57] ABSTRACT

A safety ski binding wherein the boot is releasably mounted on a sole plate which in turn is releasably secured to the ski so as to be released therefrom upon the application of forces of predetermined magnitude and direction. The sole plate may be mounted on the ski by two pairs of mounting elements, one of said mounting elements in each pair being carried by said sole plate, the other mounting element in each said pair being adapted for mounting on said ski. Said pairs of mounting means may be positioned in fixed spaced relation on opposite sides of the longitudinal center of said sole plate. One or both of said pairs of mounting elements may include a plunger of low profile not projecting above the upper surface of the sole plate. One or both of said low profile plungers may be positioned below said upper surface of said sole plate.

4 Claims, 27 Drawing Figures

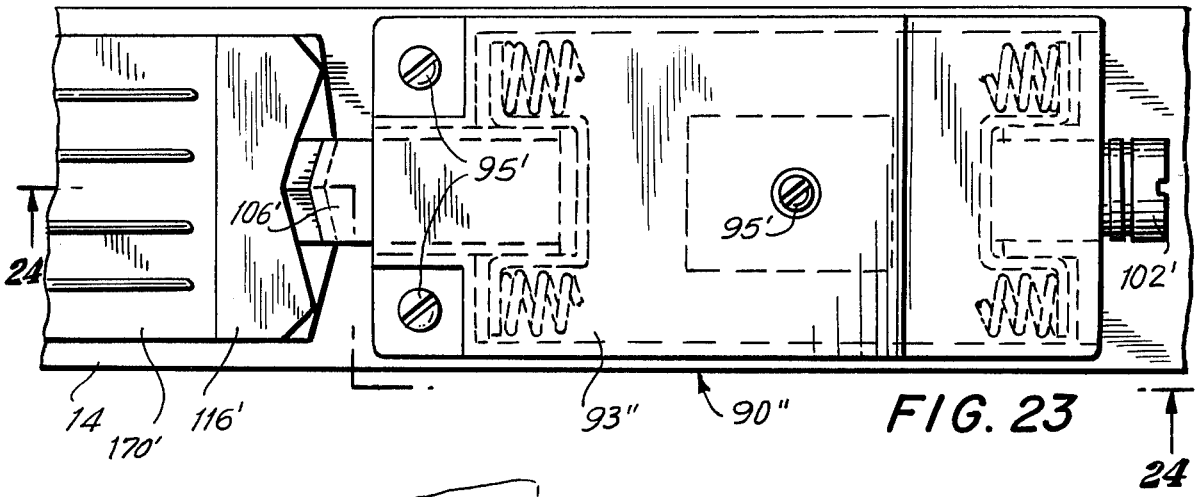
FIG. 23
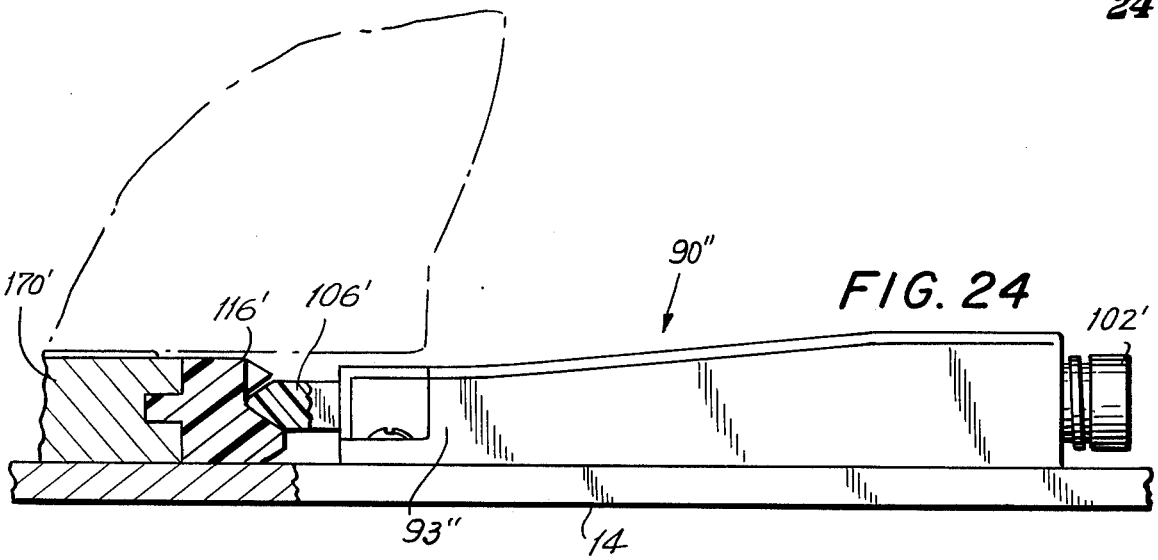
FIG. 24
FIG. 25
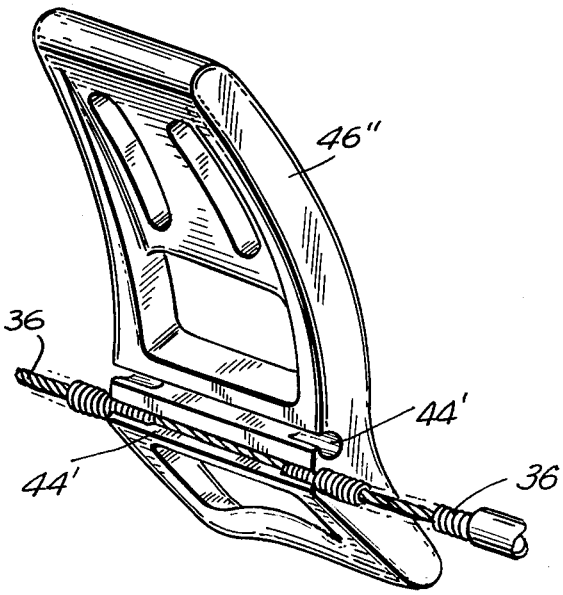

SAFETY SKI BINDING

CROSS REFERENCE TO RELATED APPLICATIONS

This application is a continuation-in-part of our copending application Ser. No. 121,422, filed Mar. 5, 1971, now U.S. Pat. No. 3,838,866.

BACKGROUND OF THE INVENTION

This invention relates generally to ski bindings adapted to permit release of the skier from the skis under certain conditions to avoid injury to the skier under such conditions. Such bindings must not only serve as a release system, but must provide firm communication between the foot of the skier and the ski for the displacement of the ski during use. In the art, a number of releasable ski binding arrangements are known. However, with the known ski binding arrangements, it has proved difficult to adequately perform both the force transmission function and the safety release function with a single binding, thereby resulting in compromises to the detriment of one or the other of these functions. Further, installation of the known ski binding arrangements requires the fitting of the binding, selected according to the size of the skier, to the ski. This has proved a laborious process frequently resulting in error and increased cost to the skier and the seller of skiing supplies. By the novel ski binding arrangement according to the invention, the foregoing difficulties in the prior art have been overcome.

SUMMARY OF THE INVENTION

Generally speaking, in accordance with the invention, a safety binding for releasably securing a boot to a ski is provided including a sole plate, first mounting means on said sole plate for releasably securing said boot to said sole plate and second mounting means for releasably securing said sole plate to said ski. The first mounting means may be adjustable to accommodate boots of a range of sizes while said second mounting means may include at least two pairs of mounting elements spaced longitudinally along said sole plate and ski on opposite sides of the longitudinal center of said plate in a single fixed relation for said range of sizes. The second mounting means are adapted for automatically releasing said sole plate from said ski on application of forces of predetermined magnitude and directions thereto.

Said second mounting means includes first and second sets of mounting elements, at least one element of each set being mounted on each of the sole plate and ski, at least one of said mounting elements including a plunger means for binding said sets of mounting elements in cooperative engagement. Said plunger may have a relatively low profile and may be mounted beneath the upper surface of the sole plate. If said plunger means is mounted on said ski adjacent said sole plate, at least the portion thereof adjacent said sole plate would not project from said ski beyond the length of said sole plate. Each of said sets of mounting elements may include a plunger means mounted below the surface of said sole plates. On the latter embodiment, said two plunger means may be formed integral with said sole plate having displaceable plunger portions thereof projecting forwardly and rearwardly, respectively, of said sole plate.

The mounting elements of both of said sets respectively define a socket and a plunger shaped to engage the sole plate against the ski and to laterally position the sole plate relative to the axis of the ski while permitting release of said sole plate from said ski at either set in either the upwardly direction relative to said ski, laterally relative to said ski or a combination thereof. Said sets of mounting elements are respectively positioned forwardly and rearwardly of the lateral centerline of said ski. Said plunger means may include means for selectively adjusting the bias force thereof.

Template means may be provided for application to said ski for indicating the position of the mounting elements on the ski. A portion of the mounting elements on the ski may be mounted integral with the ski during the formation thereof.

The first mounting means may include a rear retaining lever supported on said sole plate by cable means for engaging the rear of a user's boot to retain the boot against the sole plate. Said rear retaining lever may be formed with at least two spaced slots for releasably receiving said cable means so as to define two different pivot points for the mounting of said retaining lever, whereby, by selection of the slot in which the cable means is mounted, different shaped boots can be securely accommodated.

Accordingly, it is an object of this invention to provide a safety ski binding which readily transmits force to ths ski, while releasing the skier from the ski when the forces exceed a predetermined amount.

Another object of the invention is to provide a safety ski binding which may be utilized for a wide range of sizes while permitting a single positioning of the mounting elements on the ski.

A further object of the invention is to provide a safety ski binding wherein the boot may be mounted on a sole plate, said sole plate being adjustable to permit mounting of boots of a wide range of sizes.

Still another object of the invention is to provide a safety ski binding wherein the mounting elements secured to the ski may be mounted on the ski integral therewith during the formation of said ski.

Still another object of the invention is to provide a safety ski binding wherein the release mechanism is in the form of a biased plunger mounted beneath the sole plate or to the rear thereof.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 23 is an expanded top plan view of a plunger housing constructed in accordance with an alternative embodiment of the instant invention;

FIG. 24 is a sectional view taken along line 24—24 of FIG. 23;

FIG. 25 is a perspective view of an alternative embodiment of the retaining lever illustrated in FIG. 5;

DESCRIPTION OF THE PREFERRED EMBODIMENTS

Figures 1, 2, 3, 4:
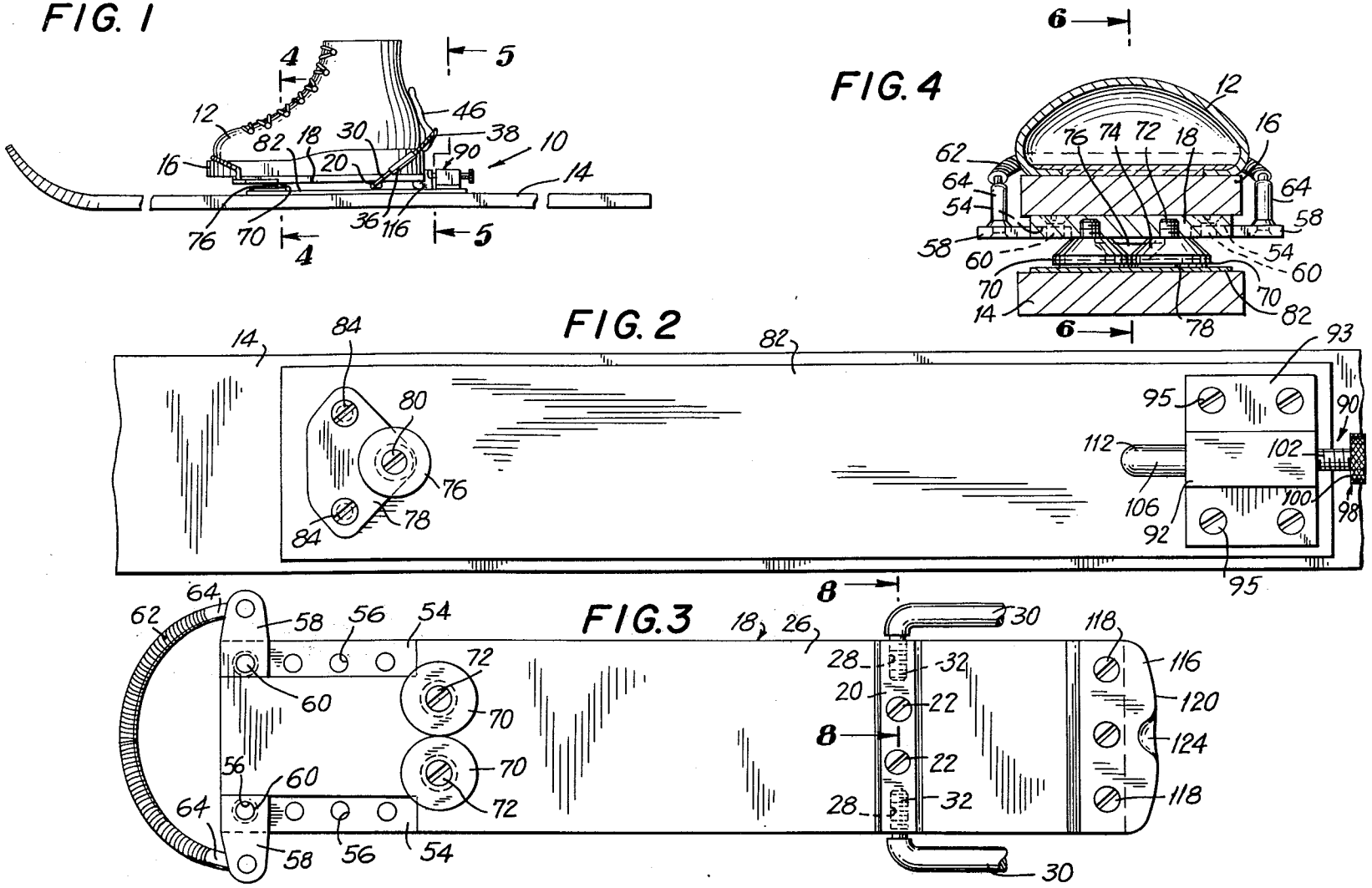
FIG. 1 is a side elevational view of a ski boot and ski joined by the safety ski binding according to the invention.
FIG. 2 is an expanded top plan view of the ski of FIG. 1 showing the mounting elements of the safety ski binding according to the invention mounted thereon.
FIG. 3 is an expanded bottom plan view of the sole plate of the safety ski binding of FIG. 1.
FIGS. 4 and 5 are expanded sectional views taken along lines 4—4 and 5—5 of FIG. 1.

Referring now to FIGS. 1–8, a first embodiment 10 of the safety ski binding according to the invention is depicted joining a ski boot 12 to a ski 14. The sole 16 of boot 12 rests on a sole plate 18 more particularly shown in FIG. 3. Said sole plate is releasably retained on the boot by front and rear boot securing means.

Figure 5:
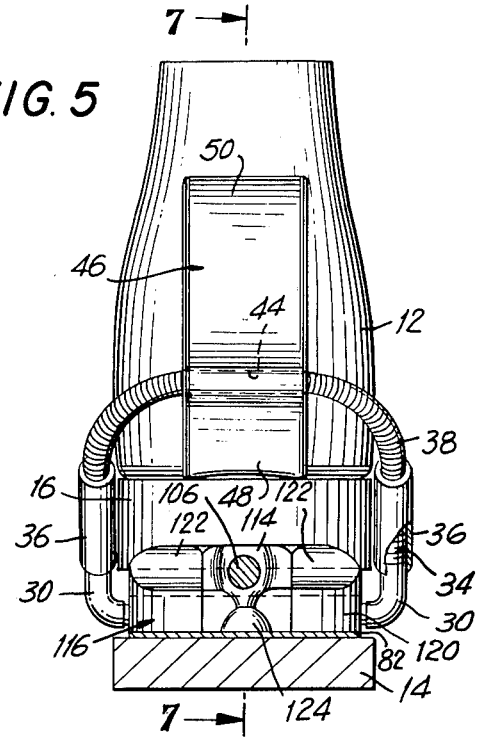
Figure 8:
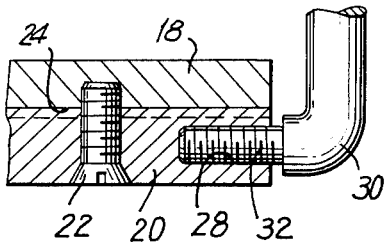
FIG. 8 is a partial sectional view taken along lines 8—8 of FIG. 3.
Figure 7:
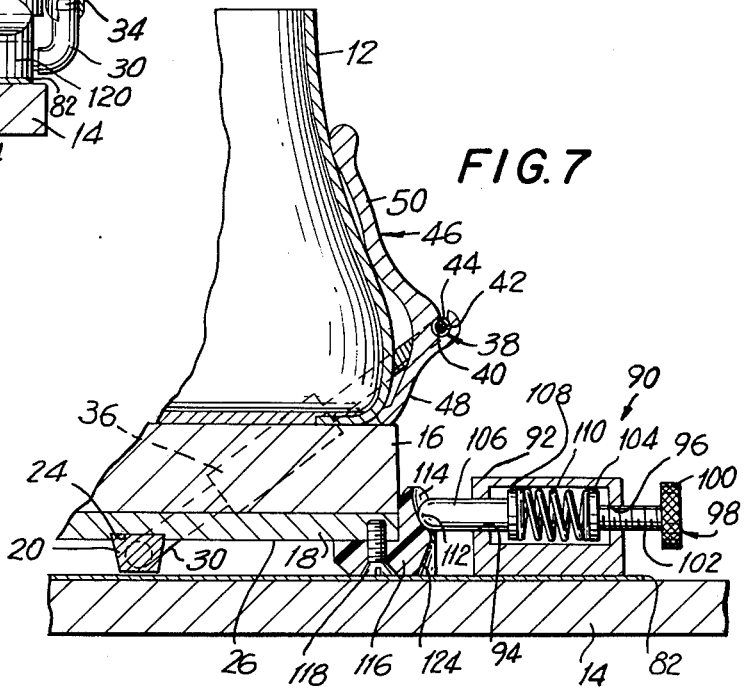
FIG. 7 is a partial sectional view taken along lines 7—7 of FIG. 5.

The rear boot securing means, as shown more particularly in FIGS. 3, 5, 7 and 8, includes a pivot block 20 mounted by means of screws 22 in a groove 24 on the bottom surface 26 of sole plate 18. Each end of pivot block 20 is formed with a threaded aperture 28 therein. An L-shaped pivot arm 30 is mounted by means of a threaded end 32 thereof in each of apertures 28. As shown in FIG. 8, pivot arms 30 are not completely screwed into threaded apertures 28 to permit the pivoting thereof. As shown in FIG. 5, the other end 34 of each of said L-shaped pivot arms is also threaded and received within a sleeve 36. A cable 38 extends between the two sleeves 36 and is received within said sleeves so as to permit the free rotation of said sleeves while the ends of said cable are firmly retained within said sleeves. In the foregoing arrangement, the length of the loop defined by L-shaped pivot arms 30, sleeves 36 and cable 38 may be adjusted by rotating the sleeves so as to thread more or less of end 34 of said L-shaped pivot arms into said sleeves. As shown in FIG. 7, cable 38 is preferably formed of a central core of braided wires 40 having a single wire 42 helically wound thereabout.

Cable 38 passes through an aperture 44 in a retaining lever 46. Said retaining lever is pivotable about said cable and is depicted in the locked position. In said position, one arm 48 thereof rests against the heel of boot sole 16, while the other arm 50 thereof engages against the rear of the upper portion of the boot 12. When so positioned, cable 38 is kept in tension and the release of the boot requires the application of substantial pressure to pivot retaining lever 46 in the clockwise direction as viewed in FIG. 7 about a fulcrum defined by the end of arm 48 of said lever. The retaining lever is put back into place in like manner, by resting the end of arm 48 against the heel of boot sole 16 and rotating the retaining lever in the counter clockwise direction as viewed in FIG. 7.

Referring now to FIG. 25, retaining lever 46″ is shown formed with at least two elongated slots 44′ traversing the width of said retaining lever 46″ for securing cable 38′ in the manner hereinabove discussed. The elongated slots permit the retaining lever 46′ to be vertically adjusted to better conform to the different boots to be secured thereby. Further, the distance between the pivot axis defined by the slot receiving the cable 38′ and the fulcrum defined by arm 48 of the lever is adjusted to insure that the lever cannot be accidentally displaced to free the boot when used with boots of a novelty of shapes. The helical wire 42′ wound about braided wires 40 has a portion removed in the region of a portion of slots 44′ so that repositioning of the cable in the other slot 44′ is readily achieved by pulling one end of helical wire 42′ free of the slot and removing the cable by passing the braided wires 40 through the narrow opening in the slot. The cable is inserted by reversing the process.

Figure 6:
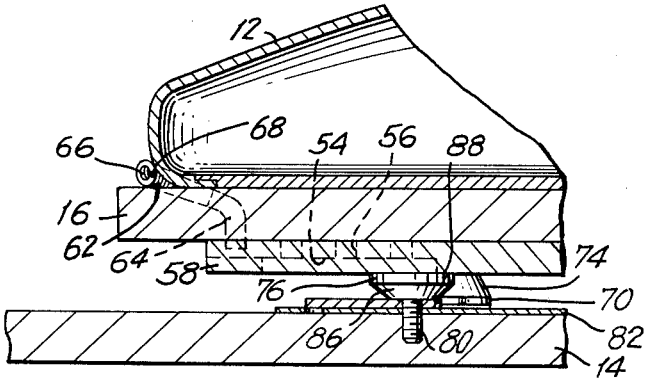
FIG. 6 is a partial sectional view taken along lines 6—6 of FIG. 4.

The front boot securing means is best shown in FIGS. 3, 4 and 6. A longitudinally extending channel 54 is formed on each side of surface 26 of sole plate 18. Said channels extend from the front end of said sole plate to a point spaced therefrom selected to permit the desired number of incremental step adjustments as described below. Longitudinally spaced apertures 56 extend through said sole plate in the region of said channels. The apertures through each channel are in substantial lateral alignment. A pair of laterally extending cable retaining members 58 are received in channels 54 in registration with a pair of said aligned apertures and are retained in position by bolts 60. A cable 62, dimensioned to be received about the front portion of sole 16 or toe of boot 12, extends between tubular portions 64 of said retaining members. Cable 62 is fixed at its ends in retaining member portions 64 and is formed from braided strands of wire 66 having a single strand of wire 68 helically wrapped therearound. The boot is inserted in the front boot securing means by slipping the toe of the boot under the loop formed by cable 62. The rear boot securing means would be connected in the manner described above.

In order to permit the accommodation of boots over a wide range of sizes, retaining members 58 may be positioned in any one of the pairs of aligned apertures depending on the size, and therefore the length of said boot.

Sole plate 18 is mounted to ski 14 by means of front and rear mounting elements. The front mounting elements consist of a pair of cam buttons 70 mounted in side-by-side relation to bottom surface 26 of said sole plate by means of bolts 72. The cam buttons are circular and have a camming surface 74, best shown in FIG. 4, in the shape of a truncated cone having a reentrant incline toward bottom surface 26 of said sole plate.

Cam button 74 defines a socket which receives a mating cam button 76 which is mounted on a support plate 78 by bolt 80, said support plate being in turn mounted through template 82 to ski 14 by bolts 84, as shown in FIGS. 2 and 6. The camming surface 86 of cam button 76 is also in the form of a truncated cone defining a reentrant inclined surface which mates with and engages against each of camming surfaces 74 of cam button 70 along a substantially line contact. The top surface 88 of cam button 76 engages against the bottom surface of sole plate 18 and supports said sole plates so that a space is defined between the surface of template 82 and cam button 74.

Spaced longitudinally along ski 14 from cam button 76 is plunger means 90, as more particularly shown in FIGS. 2 and 7. Said plunger means consists of a housing 92 having a pair of flanges 93 projectng on either side thereof. Each of said flanges is formed with a pair of apertures therethrough to permit securing of said housing to template 82 and ski 14 by means of bolts 95. Housing 92 is formed with an aperture 94 in one end wall thereof and an aperture 96 in the other end wall thereof. Extending through aperture 96, which is threaded, is adjusting member 98 formed with a knurled knob portion 100 mounted on one end of a correspondingly threaded shaft 102 and a plate member 104 mounted on the other end of said shaft. A plunger 106 extends through aperture 94, said plunger being formed with a plate portion 108 on the inner end thereof. A coil spring 110 is mounted within the housing between plate portions 108 and 104 to bias plunger 106 to the left, as viewed in FIG. 7. The end 112 of plunger 106 is rounded to define a rounded solid, i.e. a hemisphere. Said end rests in a socket 114 formed in a molded socket member 116 mounted to the rear edge of sole plate 18 by bolts 118. The rear surface 120 of socket member 116 is formed, not only with the depression defining socket 114, but with a pair of grooved paths 122 extending laterally from socket 114 and a grooved path 124 extending downwardly from said socket.

The above described coupling between sole plate 18 and ski 14 operates as follows. The tension on spring 110 is adjusted by rotating adjusting member 98 so that a force in excess of a predetermined magnitude on sole plate 18 will longitudinally displace plunger 106 to permit the disengagement of the sole plate from the ski. The force required to effect such disengagement is the force required to displace plunger 106 a distance sufficient to permit the end 112 of said plunger to pass from socket 114 into one of paths 122 and 124. If the force applied on the sole plate is such that the heel moves to the left or right, the entire sole plate twists using the camming surface between cam button 70 and 76 as a pivot point until plunger 106 is free of socket 114 and one of paths 122. If the force on the sole plate is such as to lift said sole plate, the plunger rides in path 124 in socket member 116 and, again, the front coupling is released by the camming displacement of cam button 76 relative to cam buttons 70. With the plunger means 90 mounted to the rear of sole plate 18, said plunger is proximate to the natural pivot point of the boot-sole plate assembly, namely the extension of the axis defined by the lower leg of the skier. The principal purpose of the release feature of the safety ski binding according to the invention is the avoidance of injury to the bones and joints of the leg of the skier due to excessive stress applied thereto. The positioning of plunger means 90 adjacent said point of stress, renders said plunger means particularly sensitive to the stresses sought to be avoided.

In this embodiment, the boot and sole plate are supported on template 82 and ski 14 by cam button 76, which engages bottom surface 26 of said sole plate, and by socket member 116 which rests on said template. The top surface of said cam button and the bottom surface of said socket member would be designed to minimize frictional resistance during release.

Template 82 serves to position the mounting elements defined by plunger means 90 and cam button 76 on ski 14. Said template would preferably be predrilled with suitable apertures whereby the positioning of said template on the ski will automatically position said mounting elements on said ski. If desired, template 82 may be dispensed with, a master or other template merely being utilized to mark the suitable locations for apertures to be drilled in ski 14 for the positioning of said mounting elements thereon. One advantage of the arrangement according to the invention is that the spacing between plunger means 90 and cam button 76 may be maintained fixed over a wide range of boot sizes. Thus, for example, a single binding 10 may accommodate boots of men's sizes ranging from 8 to 13. An even wider range may be utilized if desired, but it is preferable to have a second binding configuration sized to accommodate sizes 5 to 8. Thus, a single binding configuration positioned in a single location on the ski can accommodate a wide range of sizes, with the ski mounting technique being uniform over said range of sizes.

Figure 11:
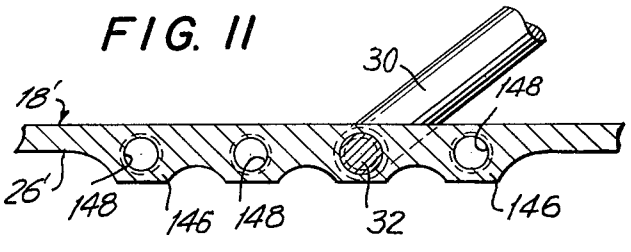
FIGS. 11 and 12 are partial sectional views taken along lines 11—11 and 12—12 of FIG. 10.
Figure 12:
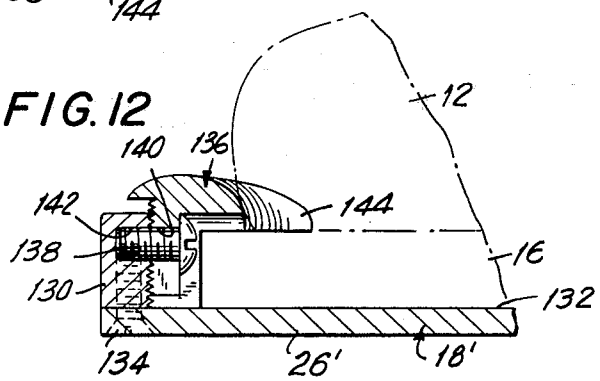
Figure 16:
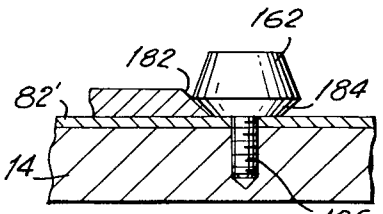
FIGS. 16 and 17 are sectional views taken along lines 6—16 and 17—17 of FIG. 15.
Figure 14:
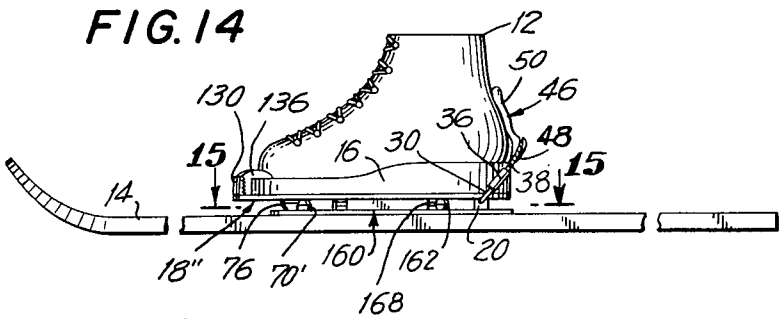
FIG. 14 is a side elevational view of a boot and ski joined by a third embodiment of the safety ski binding according to the invention.
Figure 15:
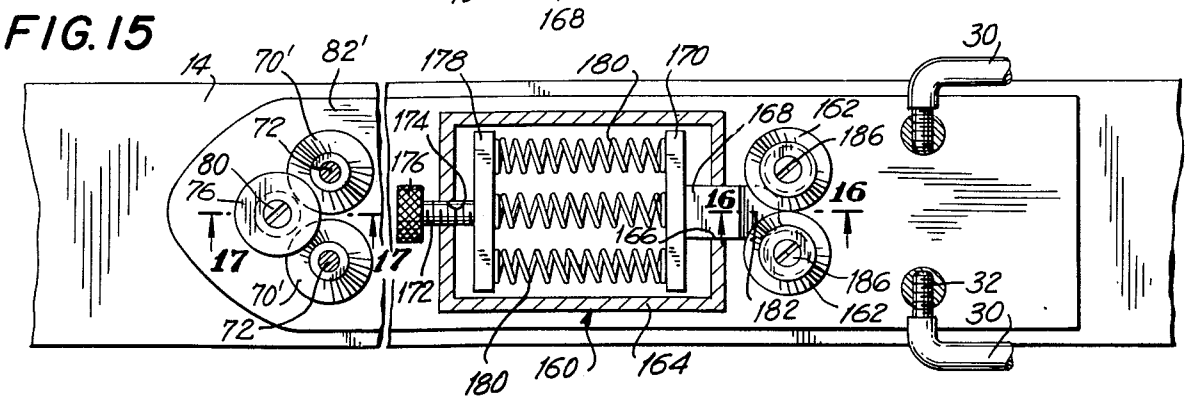
FIG. 15 is an expanded sectional view taken along lines 15—15 of FIG. 14.

A second embodiment of the arrangement according to the invention is depicted in FIGS. 9–13. Like reference numerals are utilized to identify like elements previously discussed in connection with FIGS. 1–8. In the embodiment of FIGS. 9–13, boot 12 is mounted on a sole plate 18' by means of front and rear boot securing means. The front boot securing means, shown more particularly in FIG. 12 is fixed longitudinally relative to plate 18' and consists of an upstanding toe member 130 projecting normally from the top surface 132 of said sole plate and secured thereto by means of bolts 134. A vertically displaceable toe gripper member 136 is mounted for vertical displacement relative to toe member 130. The facing surfaces of tow member 130 and toe gripper member 136 are provided with mated serrations so that, upon the tightening of bolt 138 which extends through an aperture 140 in toe gripper member 136 into a threaded bore 142 in tow member 130, said toe member and toe gripper member are effectively locked in a selected vertical position. Toe gripper member 136 is formed with a U-shaped gripper portion 144 which extends around the toe of boot 12 and engages against the top surface of sole 16 of said boot to retain said toe in place. By selectively adjusting toe gripper member 136 relative to toe member 130, the front boot securing means may be adjusted to accommodate boots having soles of varying thicknesses.

While in the embodiment of FIGS. 1–8, the front boot securing means is longitudinally variable, in the embodiment of FIGS. 9–13, the rear boot securing means is longitudinally variable, as more particularly shown in FIGS. 11 and 12. Specifically, in place of a single pivot block, sole plate 18' is formed with a plurality of laterally extending projections 146 extending from surface 26' thereof. Each of said projections is formed, on the opposed sides thereof, with a threaded aperture 148 corresponding to the threaded apertures 28 in pivot block 20 of the first embodiment. L-shaped pivot arms 30 are received within apertures 148, the balance of the rear boot securing means being substantially identical to the structure of the first embodiment as described above. By selectively mounting pivot arms 30 in one of the pairs of apertures 148, the sole plate 18' may be adapted to receive boots of a wide range of sizes.

The mounting means between sole plate 18' and ski 14 of the embodiment of FIGS. 9–13 is substantially identical to that of the embodiment of FIGS. 1–8, except that template 82 is omitted as described above, and cam button 76 is replaced by a pie-shaped camming member 150 mounted on ski 14 by means of bolts 152. Said pie-shaped camming member is formed with a curved camming surface 154 defining a segment of the surface of a truncated cone and having a reentrant inclined surface which mates with the reentrant inclined surface of cam button 70'. The later camming buttons are thicker than camming button 70 and serve to provide part of the support for sole plate 18' on ski 14. Said sole plate is also supported by socket member 116, as in the previous embodiment.

Turning now to FIGS. 14–17, a third embodiment of the safety ski binding according to the invention is depicted. By way of example, boot 12 may be mounted on a sole plate 18'' which is provided with front and rear securing means which are longitudinally fixed on said sole plate. However, the longitudinally displaceable front sole securing means of the embodiment of FIGS. 1–8 or the longitudinally displaceable rear sole securing means of the embodiment of FIGS. 9–13, or both said embodiments may be incorporated in the embodiment of FIGS. 14–17. Said embodiment differs from the previously described embodiments in the mounting means between sole plate 18'' and template 82' and ski 14. While the front coupling means consisting of cam buttons 70 and 76 are substantially identical to the previous embodiments the plunger means and socket member have been dispensed with and replaced by a plunger means 160 and a pair of camming buttons 162.

Plunger means 160 includes a housing 164 mounted on the bottom surface of sole plate 18''. Received within said housing and projecting through an aperture in an end wall thereof is a tongue shaped plunger 168 having a laterally extending portion 170 within said housing. An adjusting means is provided consisting of a threaded shaft 172 projecting through an aperture 174 in the other end wall of said housing, a knurled knob 176 mounted on the outer end of shaft 172, and a laterally extending member 178 mounted on the inner end of said shaft so that said shaft may freely rotate relative to said laterally extending member but carry said laterally extending member during the longitudinal displacement of said shaft. Aperture 174 in housing 164 is threaded so that the rotation of knurled knob 176 results in the longitudinal displacement in said housing of laterally extending portion 178 of the adjusting means. A plurality of coil springs 180, are shown by way of example, as a biasing means between the laterally extending portion of the adjusting means and the laterally extending portion 170 of plunger 168. Said springs serve to bias plunger 168 against cam buttons 162. The outer end of plunger 168 is formed with an inclined curved surface 182 which engages along a substantially line contact with the camming surfaces 184 of cam buttons 162. As in the previous embodiments, camming surfaces 184 are truncated cones defining reentrant inclined surfaces. Said camming buttons are secured to template 82' and ski 14 by bolts 186.

The plunger means 160 is specifically designed to have a low profile so as to fit under sole plate 18'' without engaging template 82'. Said sole plate is supported by cam buttons 70' and 162. The operation of the embodiment of the safety ski binding according to the invention shown in FIGS. 14–17 is similar to the operation of the previous embodiments except that the camming surface 182 of plunger 168 rides upwardly or sidewardly on the camming surfaces of cam buttons 162. If desired, plunger means 160 may be mounted on ski 14, in which case cam buttons 162 would be mounted on sole plate 18''.

The point of contact between camming surface 182 of plunger 168 and cam buttons 162 is preferably located in a region defined by an extension of the longitudinal axis of the skier's lower leg in the various positions assumed by said lower leg. When so positioned, the point of contact is precisely at the critical point of stress, as described above, and is optimally sensitive to the stresses applied to the legs and ankles of the skier. Further, the front coupling defined by cam buttons 70' and 76 is preferably positioned at or forward of the ball of the foot of the wearer. Experimentation has found that the variation between the ankle line relative to the heel or the ball of the foot is relatively slight over a range of sizes extending from mens sizes 8–13. Accordingly, a single positioning of the mounting means between the sole plate and the ski can serve said wide range of sizes while providing nearly optimum performance characteristics for each of said sizes. This is particularly true where the heel of the boot is fixed and the front boot securing means is longitudinally varied as shown in the first embodiment of FIGS. 1–8.

Figure 18:
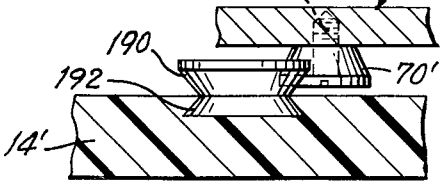
FIG. 18 is a sectional view corresponding to FIG. 17 showing an alternate embodiment of the safety ski binding according to the invention.
Figure 17:
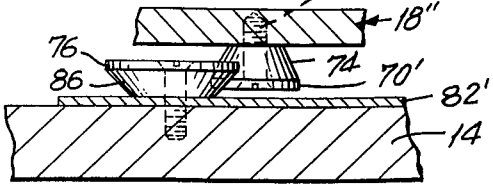

Turning now to FIG. 18, an alternate embodiment for securing the mounting elements to the ski is depicted. In said embodiment, a cam button 190 is embedded in the material of ski 14' during the forming processes of said ski. Cam button 190 is provided with a peripheral ridge portion 192 which coacts with the material of ski 14' to retain said cam button in position. This mounting approach, which is also applicable to the housing 92 of plunger means 90 of the embodiment of FIGS. 1–8, is particularly usable where the ski is formed of a plastic material. This arrangement is possible principally because of the fixed spacial relationship between the mounting elements on the ski binding according to the invention. Because of this fixed spacial relationship, it is economical to secure the mounting elements according to the invention in the ski, since the ski would still be usable with a wide range of boot sizes.

FIGS. 19–22 depict a fourth embodiment of the ski binding according to the invention wherein like reference numerals have been utilized to identify like components in the above-described embodiments. In said fourth embodiment, boot 12 is secured to a sole plate 170 by a fixed front boot securing means and a displaceable rear boot securing means. Said front boot securing means utilizes a cable 62 similar to the cable of the embodiment of FIG. 1, but said cable is fixedly secured to sole plate 170 by end members 172. The front end of sole plate 170 is formed with laterally extending wing portions 174 adapted to extend laterally relative to the sole 16 of the boot, whereby said end members may be readily secured to said sole plate. The rear boot securing means is similar in construction to the rear boot securing means depicted in the embodiment of FIGS. 9–13. However, the embodiment of FIGS. 19–22 differs in that sole plate 170 is formed with a thickened region 176 having a plurality of laterally extending apertures 178 therethrough, said apertures being spaced longitudinally along said sole plate. A keyway slot 180 is formed in the inner surface of said apertures. L-shaped pivot arms 182 are provided, similar in construction to L-shaped pivot arms 30 of the above-described embodiments, except that end 134 thereof is not threaded, but rather, is smooth and provided with a key 186 at the end thereof dimensioned to be received in keyway slot 180. The other end of L-shaped pivot arm 182 is received within sleeve 36 in the manner described above. The bottom surface 188 of sole plate 170 is formed with a pair of outer longitudinally extending channels 190 and a pair of inner longitudinally extending channels 192 dimensioned to intersect laterally extending apertures 178 and to receive key 186 when said key is aligned therewith and L-shaped pivot arms 182 are pivoted.

The foregoing construction permits the quick insertion and removal of pivot arms 182, and also permits a lateral size adjustment. Thus, to insert the pivot arms, it is necessary merely to align end 184 of said pivot arms so that key 186 aligns with keyhole slot 180, slide said pivot arm end into an aperture until said key is aligned with one of the channels 190 and 192 and pivot said L-shaped pivot arm. After pivoting, said pivot arm is locked in position. By aligning keys 186 with channels 192, as opposed to channels 190, the rear boot securing means can firmly retain a narrower boot.

The boot securing means of the embodiment of FIGS. 19–22 also differs in that the retaining lever 46′ thereof is formed with a pair of parallel slot apertures 194 through the arm 50′ thereof. A strap 196 is threaded through said slot apertures, extends about boot 12, and is secured at the front of said boot by buckle 198. Strap 196 servies to provide an affirmative retaining means for retaining lever 46′ to prevent the inadvertent releasing thereof during skiing. An anti-runaway strap 200 is also provided having a first loop 202 at one end through which strap 196 is threaded and a second loop 204 at the other end thereof through which is threaded wire retainer 206. Said wire retainer is received in a pair of opposed apertures formed in the side of housing 92′ of plunger means 90′. Said anti-runaway strap is provided with sufficient slack so as not to interfere with the release of sole plate 170 from ski 14. However, upon such release, said anti-runaway strap prevents the ski from passing out of the reach of the skier.

Plunger means 90′ is in other respects similar in construction to the plunger means depicted in FIGS. 1–8 except that the portion of the threaded shaft 102′ of adjusting member 98′ is formed with a series of longitudinally spaced index lines 208 which provide a means whereby the skier can judge the force required to release the ski binding according to the invention.

Figure 9:
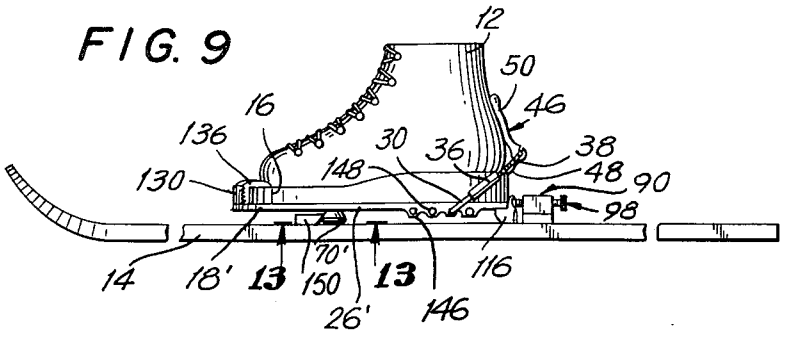
FIG. 9 is a side elevational view of a boot and ski joined by a second embodiment of the safety ski binding according to the invention.
Figure 10:
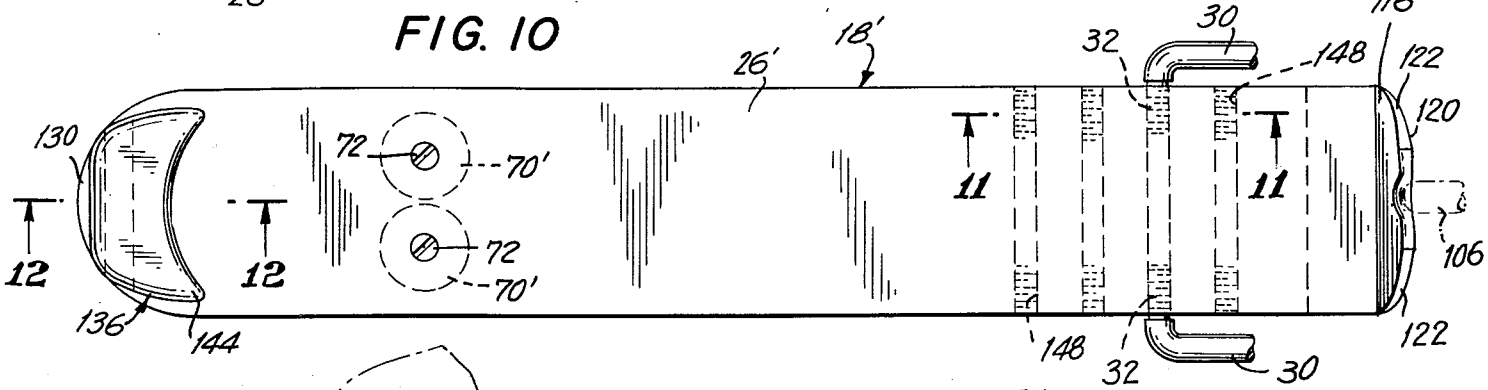
FIG. 10 is an expanded top plan view of the sole plate of the safety ski binding of FIG. 9.
Figure 13:
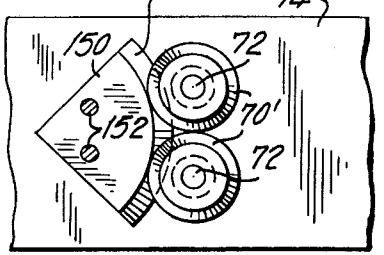
FIG. 13 is an expanded partial sectional view taken along lines 13—13 of FIG. 9.
Figure 19:
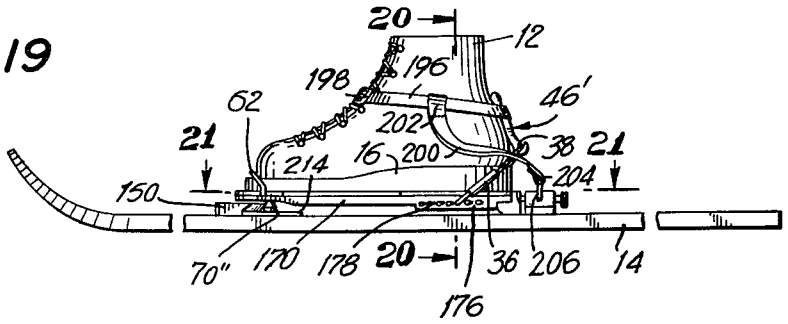
FIG. 19 is a side elevational view of a boot and ski joined by a fourth embodiment of the safety ski binding according to the invention.

Referring now to FIGS. 23 and 24, plunger means 90″ is illustrated which plunger means is in other respects similar in construction to the plunger means depicted in FIGS. 19 through 22 except that the housing 93′ is formed with a low profile. Specifically, the portion of the housing 93′ near the plunger and socket means is formed with a height lower than that of the sole plate 170′ and the socket means 116′ disposed on the end of said sole plate. The forming of housing 93′ with a height lower than the sole plate provides a clearance of the boot 12 over the housing 93′ whereby the plunger 90′ can be utilized with any sized boot. The forming of housing 93′ with a height lower than the sole plate, permits the heel of the boot to project rearwardly beyond the rear end of the sole plate and overlap the plunger means, an arrangement impossible where the plunger means is shaped as depicted in FIGS. 1, 9 and 19. The embodiment of FIGS. 23 and 24 permits a sole plate having a fixed front securing means as depicted in FIG. 19 to accommodate a wider range of boot sizes without interfering with the rear plunger means. The low profile is achieved by providing a plurality of parallel springs 180′, as illustrated in plunger means 160 of FIG. 15, in place of the single large spring of FIG. 7.

Figure 20:
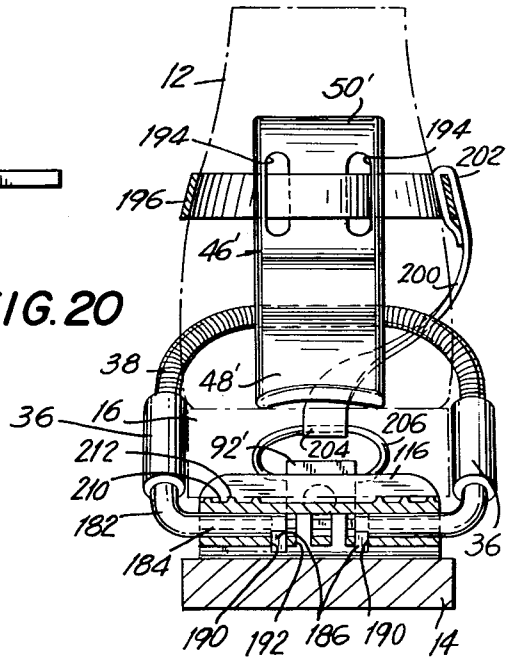
FIGS. 20 and 21 are expanded partial sectional views taken along lines 20—20 and 21—21 respectively of FIG. 19.
Figure 22:
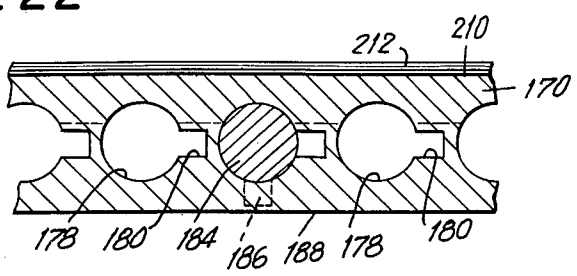
FIG. 22 is an expanded partial sectional view taken along lines 22—22 of FIG. 21.
Figure 21:
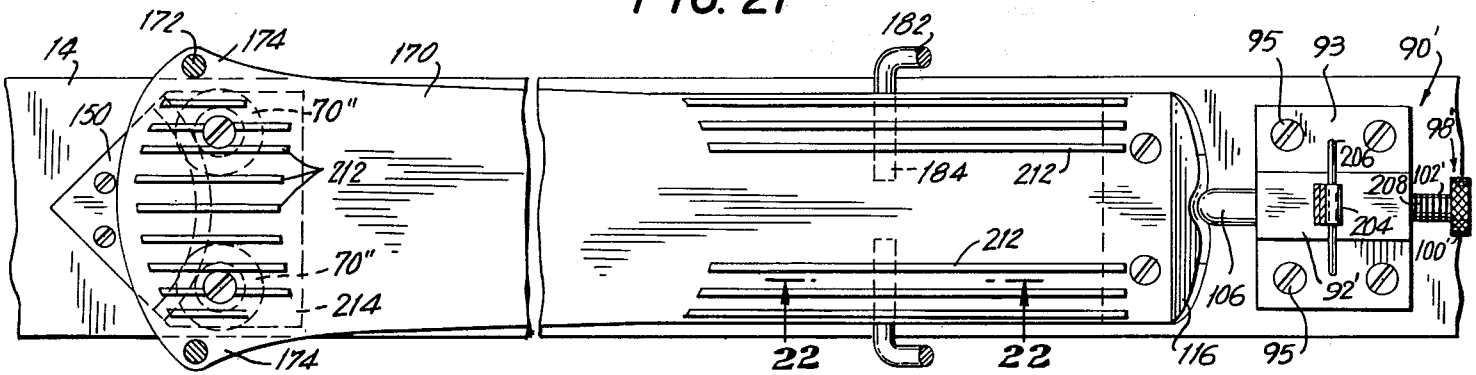

Referring now to FIGS. 20–22, it is seen that the top surface 210 of sole plate 170 is formed with a series of longitudinally extending ridges 212 projecting therefrom. Said ridges serve to support the sole 16 of boot 12 in spaced relation to surface 210 of sole plate 170 so as to permit space for the clearance of snow and ice therebetween to insure a firm engagement between said boot and said sole plate.

The embodiment of FIGS. 19–21 also differs in the front coupling between sole plate 170 and ski 14 as more particularly shown in FIG. 21. This feature of this embodiment is similar in construction to the embodiment of FIGS. 9–14 except that buttons 70″ are laterally spaced on said sole plate, although they cooperatively engage with pie shaped camming member 150 in the manner described above. Further, instead of resting directly on ski 14, buttons 70″ rest on a friction plate 214 mounted directly to ski 14. Such a friction plate would be used when the material of ski 14 was not sufficiently strong to bear the frictional displacement of buttons 70″.

The various features of each of the above-described embodiments of the ski binding according to the invention may be applied to other embodiments of said ski binding to produce still further embodiments incorporating various combinations of features according to the invention. Thus, the rear boot securing means of the embodiment of FIGS. 19–21 may be applied to any of the embodiments of FIGS. 1–18.

In each of the above-described embodiments, the coupling means between the sole plate and the ski includes two pairs of mounting elements which cooperate at contact points. In each of said embodiments, the contact point between the front pair of contact elements is positioned under the sole plate between the end of said sole plate and the longitudinal center line thereof. In the embodiment of FIGS. 1–13 and 19–22, the contact point between the rear mounting elements is positioned rearwardly of the sole plate and of said sole plate center line. On the other hand, in the embodiment of FIGS. 14–17, the contact point between the front mounting elements is positioned as described above, while the contact point between the rear mounting elements is positioned under the sole plate on the opposite side of said center line. The latter construction offers the advantage of positioning all of the mounting elements under this sole plate so that said mounting elements do not affect the swing weight of the ski. In other words, the ski binding of FIGS. 14–17 adds no additional weight to the ski outside the perimeter of the ski boot so that the balance of the ski may be maintained if the binding is properly mounted on said ski.

Each of the foregoing arrangements incorporates a coupling defined by a pair of adjacent cam buttons. Said pair of adjacent cam buttons can be replaced by a unitary cam member, if desired, but the base of the socket defined in said cam member should be opened to permit the clearance of snow therethrough, so as to permit the reapplying of the sole plate to the ski after release while on the ski slope.

Figure 26:
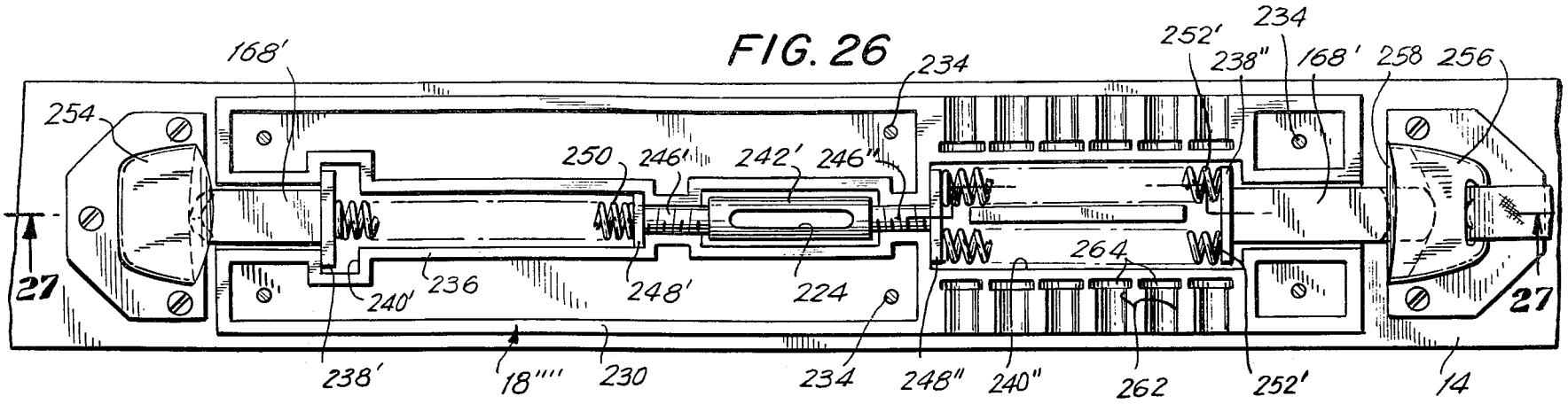
FIG. 26 is a sectional view of an alternative embodiment of the safety ski binding according to the invention.
Figure 27:
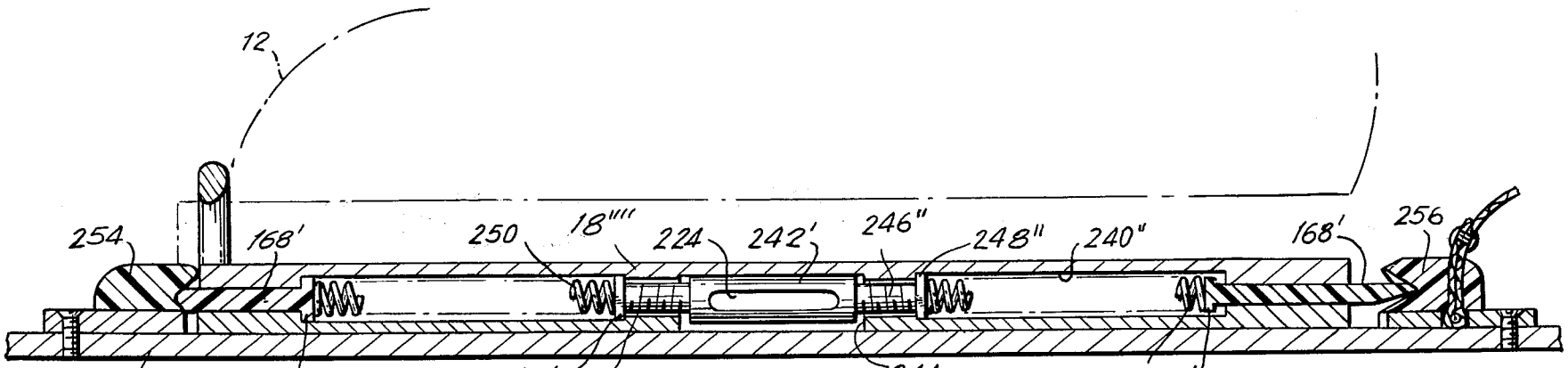
FIG. 27 is a sectional view taken along line 27—27 of FIG. 26.

Still another embodiment is depicted in FIG. 26, wherein the sole plate 18'''' forms a housing for a double plunger mechanism. Said sole plate is defined by a base member 230 and a cover portion 232 (FIG. 27) held to said base portion by rivet 234. Base 230 is formed with an internal wall 236 defining chambers for receiving said double plunger mechanism and for limiting the displacement of the respective components thereof. Said double plunger mechanism consists of a front plunger 168' and a rear plunger 168'' projecting forwardly and rearwardly respectively of sole plate 18''''. The inner ends of plungers 168' and 168'' are respectively formed with a laterally projecting flange portion 238' and 238'' which respectively ride in chambers 240' and 240'' to limit the traverse of the respective plungers.

The plunger mechanism includes a central turnbuckle 242 which projects into and is accessible through an opening 244 in base 230. The turnbuckle is formed with a plurality of slots 224 therethrough to permit rotation thereof from outside of the sole plate. Threaded into turnbuckle 242 are a pair of threaded shafts 246' and 246''. At the end of each of said shafts is an end plate 248' and 248'' respectively. A single front coil spring 250 is engaged between plate 248' and flange 238' to bias plunger 168' in the forwardly direction. A pair of coil springs 252 are compressed between end plate 248'' and flange 238'' to bias plunger 168'' in the rearwardly direction. The bias force applied to the respective plungers is coordinately adjusted through the rotation of turnbuckle 242.

The sole plate is held on ski 14 by a front socket member 254 and a rear socket member 256 shaped to define camming surfaces for cooperation with the sculptured tongues defining the outer ends of plungers 168' and 168'' respectively. The camming surfaces on the respective socket members and plungers are shaped to define paths for the separation of the sole plate from the ski from either the front or the rear in both lateral directions relative to the ski as well as the separation of the sole plate upwardly from the ski. At least the rear socket member is provided with a camming surface 258 on the upper edge thereof for engagement against the lower camming surface of plunger 168'' during mounting of the sole plate on the ski.

The sole plate preferably engages against the front socket member 254 to prevent displacement during skiing.

The sole plate is formed with a plurality of bores 262 in the side wall thereof corresponding to apertures 148 in the embodiment of FIG. 9 for receiving pivot arms such as pivot arms 30 to hold the rear of the boot on the sole plate. The pivot arms would be formed with projections, bores 262 would be formed with keyhole slots, and enlarged regions 264 at the end of each bore are provided to receive the projections on pivot arms 30 and to permit the pivoting of said pivot arms.

While in the embodiment depicted, the rear plunger is biased by two springs, any combination of springs biasing the front and rear plunger may be provided was desired by the design of the specific binding. The cover and base of the sole plate may be joined by welding or other appropriate means. The sole plate may be formed from plastic material. While the embodiment depicted in the drawings provides the socket mounted to the ski and the plunger being provided with a tongue for receipt in the socket, the socket could be mounted on the plunger, a member provided with a projecting tongue being fixedly mounted on the ski.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A safety binding for releasably securing a boot having a sole formed with a lower surface to a ski, comprising a sole plate having an upper surface substantially defining a plane supporting said boot lower surface; means for releasably securing said boot to said sole plate; and first and second sets of means for releasably affixing said sole plate to said ski positioned respectively forwardly and rearwardly of a line intermediate to the ends of and normal to the long axis of said sole plate, said sets of means being shaped to permit both relative lateral and relative normal displacement of said ski and sole plate at both sets thereof, both of said sets of means including cooperative interengaging surfaces defining a pocket and a projection into said pocket, one of each of which surfaces is positioned on said ski and the other of each of which surfaces is positioned on said plate and the surfaces of each of which sets of means contact each other along an interface shaped to cause said plate to be impelled toward said ski and to laterally position said plate relative to said ski in the region of both of said sets of means as said cooperating interengaging surfaces of each such set are concurrently impelled toward each other; and means for impelling said surfaces in each of said sets toward each other concurrently, which impelling means is sufficiently yielding to permit said cooperating interengaging surfaces of either of said sets of means to become disengaged from each other through relative displacement by motion having an axial component and either a lateral component, a normal component, or a combination of lateral and normal components due to the application of force moments counter-directional to the force moments imparted to said cooperating interengaging surfaces by said impelling means, said impelling means including at least one plunger means displaceable substantially axially relative to said ski and bearing at one end thereof one of said interengaging surfaces of the rearwardly of said sets of means, at least the portion of said plunger means bearing said one interengaging surface and the other interengaging surface of said rearwardly set of means being positioned below the plane defined by said upper surface of said sole plate, the forwardly of said set of means being positioned beneath said sole plate.

2. In a safety binding for releasably securing a boot to a ski including a sole plate, first mounting means on said sole plate for securing said boot to said sole plate, said first mounting means permitting the selective release of said sole plate from said boot; and second mounting means on said sole plate and ski securing said sole plate to said ski, said second mounting means being adapted for automatically releasing said sole plate from said ski upon the application of forces of predetermined magnitude and direction thereto, the improvement which comprises said first mounting means including rear mounting means having cable means, means for securing said cable means to said sole plate and lever means for engaging against the rear of said boot, said lever means being formed with at least two spaced elongated slots for receiving said cable means to define alternative pivoting axes for said lever, whereby said lever, by selection of the slot in which said cable means is received, may engage and hold the rear of boots of different configurations.

3. A safety binding for releasably securing a boot having a sole formed with a lower surface to a ski comprising a sole plate having an upper surface substantially defining a plane supporting said boot lower surface; first mounting means on said sole plate for releasably securing said boot to said sole plate; and second mounting means for releasably securing said sole plate to said ski including longitudinally displaceable plunger means mounted on said ski rearwardly of said sole plate; means defining at least two cooperative interengaging surfaces defining a pocket and a projection into said pocket, one of which surfaces is positioned on the rear end of said sole plate and the other of said surfaces is positioned at the end of said plunger means facing said sole plate, means for biasing said plunger to engage together said interengaging surfaces while permitting longitudinal displacement of said plunger to permit separation of said pocket and projection upon the application of forces of predetermined magnitude and direction to said sole plate, and at least a pair of coupling means positioned beneath said sole plate forward of said interengaging surfaces, one of each pair of coupling means being mounted on each of said sole plate and ski, said coupling means being provided with camming surfaces for the relative displacement thereof during release of said sole plate from said ski, at least a portion of said plunger means bearing an interengaging surface and the other of said interengaging surfaces being positioned below the plane defined by said upper surface of said sole plate, whereby the rearwardly portion of said boot may project rearwardly from said sole plate without interfering with the operation of said plunger means.

4. A safety binding as recited in claim 3, said first mounting means being adjustable to accommodate boots of a range of sizes, said first mounting means including rear mounting means having cable means, means for releasably securing said cable means to said sole plate at a plurality of positions spaced along the axis of said ski and lever means for engaging against the rear of said boot, said lever means being formed with at least two spaced elongated slots for receiving said cable means to define alternative pivoting axes for said lever, whereby said lever, by selection of the slot in which said cable means is received, may engage and hold the rear of boots of different configurations.

* * * * *